US007963318B2

(12) United States Patent
Wölpert et al.

(10) Patent No.: US 7,963,318 B2
(45) Date of Patent: Jun. 21, 2011

(54) FINNED TUBE FOR THE THERMAL CRACKING OF HYDROCARBONS, AND PROCESS FOR PRODUCING A FINNED TUBE

(75) Inventors: Peter Wölpert, Zierenberg (DE); Benno Ganser, Alzenau (DE); Dietlinde Jakobi, Köln (DE); Rolf Kirchheiner, Iserlohn (DE)

(73) Assignee: Schmidt + Clemens GmbH + Co., KG, Lindlar (DE)

( * ) Notice: Subject to any disclaimer, the term of this patent is extended or adjusted under 35 U.S.C. 154(b) by 214 days.

(21) Appl. No.: 12/025,398

(22) Filed: Feb. 4, 2008

(65) Prior Publication Data

US 2008/0135223 A1 Jun. 12, 2008

Related U.S. Application Data

(60) Division of application No. 10/945,860, filed on Sep. 21, 2004, now abandoned, which is a continuation of application No. PCT/EP03/04827, filed on May 8, 2003.

(30) Foreign Application Priority Data

Jul. 25, 2002 (DE) ..... 102 33 961

(51) Int. Cl.
*F28F 1/30* (2006.01)

(52) U.S. Cl. ..... 165/184; 165/181; 165/179

(58) Field of Classification Search ..... 165/183, 165/184, 179, 177, 181
See application file for complete search history.

(56) References Cited

U.S. PATENT DOCUMENTS

| | | | | |
|---|---|---|---|---|
| 4,876,065 | A | 10/1989 | Rockel et al. | |
| 5,950,718 | A | 9/1999 | Sugitani et al. | |
| 6,250,340 | B1 * | 6/2001 | Jones et al. | 138/177 |
| 6,419,885 | B1 * | 7/2002 | Di Nicolantonio et al. | 165/184 |
| 6,913,074 | B2 * | 7/2005 | Yamamoto et al. | 165/184 |
| 2001/0001399 | A1 | 5/2001 | Kleemann | |
| 2001/0006106 | A1 * | 7/2001 | Beutler et al. | 165/184 |
| 2003/0019533 | A1 | 1/2003 | Demarest et al. | |

FOREIGN PATENT DOCUMENTS

| | | | |
|---|---|---|---|
| DE | 44 27 859 | A | 10/1995 |
| DE | 195 23 280 | A | 1/1997 |
| EP | 1 136 541 | A | 2/2001 |
| GB | 969796 | | 9/1964 |

* cited by examiner

*Primary Examiner* — Teresa J Walberg
(74) *Attorney, Agent, or Firm* — Henry M. Feiereisen; Ursula B. Day

(57) ABSTRACT

A finned tube for the thermal cracking of hydrocarbons in the presence of steam is defined by a tube axis and includes a plurality of inner fins. The fins are inclined at an angle of 20° to 40° in relation to the tube axis and have a flank angle of 16° to 25°.

14 Claims, 10 Drawing Sheets

Circumferential velocities in profiles with differing inclination with respect to the tube axis Tube radius (mm)

Distribution of the circumferential velocities in profile 3 with 30° pitch over the radius of the profiled tube Profile shapes with temperature profile in the fluid (naphtha) at 9950 mm plotted over a radius in the tube (peak = profile peak, valley = profile valley)

Comparison of the tube metal temperatures

Tube circumference from the light side to the dark side (°)
Temperature distribution on the tube inner wall at 9950 mm Illustration of a profile segment for
mathematical definition of flank angle (β) and profile radii (R)

Smooth tube

Profile 1

FINNED TUBE FOR THE THERMAL CRACKING OF HYDROCARBONS, AND PROCESS FOR PRODUCING A FINNED TUBE

CROSS-REFERENCES TO RELATED APPLICATIONS

This application is a division of prior filed copending U.S. application Ser. No. 10/945,860, filed Sep. 21, 2004, the priority of which is hereby claimed under 35 U.S.C. §120, and which is a continuation of prior filed PCT International application no. PCT/EP2003/004827, filed May 8, 2003, which designated the United States and has been published but not in English as International Publication No. WO 2004/015029 and on which priority is claimed under 35 U.S.C. §120 and which claims the priority of German Patent Application, Serial No. 102 33 961.9, filed Jul. 25, 2002, pursuant to 35 U.S.C. 119(a)-(d).

The contents of U.S. application Ser. No. 10/945,860, PCT International application no. PCT/EP2003/004827, and German Patent Application, Serial No. 102 33 961.9 are incorporated herein by reference in their entireties as if fully set forth herein.

BACKGROUND OF THE INVENTION

The present invention relates to a finned tube for the thermal cracking of hydrocarbons in the presence of steam, in which the charge mixture is passed through externally heated tubes with helical inner fins.

Nothing in the following discussion of the state of the art is to be construed as an admission of prior art.

Tube furnaces in which a hydrocarbon/steam mixture is passed through series of individual or meandering tubes (cracking tube coils) at temperatures of above 750° C. made from heat-resistant chromium-nickel-steel alloys with a high resistance to oxidation or scaling and a high resistance to carburization have proven suitable for the high-temperature pyrolysis of hydrocarbons (crude oil derivatives). The tube coils comprise vertically running, straight tube sections which are connected to one another via U-shaped tube bends or are arranged in parallel with one another; they are usually heated with the aid of side-wall burners and in some cases also with the aid of bottom burners and therefore have what is known as a light side, facing the burners, and what is known as a dark side, which is offset by 90° with respect thereto, i.e. runs in the direction of the rows of tubes. The mean tube metal temperatures (TMT) are in some cases over 1000° C.

The service life of the cracking tubes is dependent to a very significant extent on the creep resistance and the carburization resistance, and also the coking rate, of the tube material. A crucial factor for the coking rate, i.e. the growth of a layer of carbon deposits (pyrolysis coke) on the tube inner wall is, in addition to the type of hydrocarbons used, the cracking gas temperature in the region of the inner wall and what is known as the operating severity, which conceals the influence of the system pressure and the residence time in the tube system on the ethylene yield. The operating severity is set on the basis of the mean outlet temperature of the cracking gases (e.g. 850° C.). The higher the gas temperature in the vicinity of the tube inner wall above this temperature, the more extensive the growth of the layer of pyrolysis coke becomes, and the insulating action of this layer allows the tube metal temperature to increase still further. Although the chromium-nickel-steel alloys containing 0.4% of carbon, over 25% of chromium and over 20% of nickel, for example 35% of chromium, 45% of nickel and if appropriate 1% of niobium, that are used as tube material have a high resistance to carburization, the carbon diffuses into the tube wall at defects in the oxide layer, where it leads to considerable carburization which can amount to carbon contents of from 1% to 3% at wall depths of 0.5 to 3 mm. This is associated with considerable embrittlement of the tube material, with the risk of crack formation in the event of fluctuating thermal loads, in particular when the furnace is being started up and shut down.

To break down the carbon deposits (coking) on the tube inner wall, it is necessary for cracking operation to be interrupted from time to time and for the pyrolysis coke to be burnt with the aid of a steam/air mixture. This requires operation to be interrupted for up to 36 hours, and therefore has a considerable adverse effect on the economics of the process.

It is also known from GB Patent 969 796 to use cracking tubes with inner fins. Although inner fins of this type result in an internal surface area which is a good few percent, for example 10%, larger, with a corresponding improvement in the heat transfer, they are also associated with the drawback of a considerably increased pressure loss compared to a smooth tube, on account of friction at the enlarged tube inner surface. The higher pressure loss requires a higher system pressure, which inevitably changes the residence time and has an adverse effect on the yield. An additional factor is that the known tube materials with high carbon and chromium contents can no longer be profiled by cold-working, for example cold-drawing. They have the drawback that their deformability decreases greatly as the hot strength rises. This has led to the high tube metal temperatures of, for example, up to 1050° C., which are desirable with regard to the ethylene yield, requiring the use of centrifugally cast tubes. However, since centrifugally cast tubes can only be produced with a cylindrical wall, special shaping processes are required, for example removal of material by electrolytic machining or a shaping welding process if internally finned tubes are to be produced.

It would therefore be desirable and advantageous to improve the economics of thermal cracking of hydrocarbons in tubular furnaces with externally heated tubes having helical inner fins.

SUMMARY OF THE INVENTION

According to one aspect of the present invention, a finned tube for the thermal cracking of hydrocarbons in the presence of steam is defined by a tube axis and includes a plurality of inner fins, with the fins being inclined at an angle of 20° to 40° in relation to a tube axis and having a flank angle of 16° to 25°.

In a process according to another aspect of the present invention, a swirling flow is generated in the immediate vicinity of the fins of preferably a centrifugally cast tube and this swirling flow is converted into a core zone with a predominantly axial flow at increasing radial distance from the fins. The transition between the outer zone with the swirling flow and the core zone with the predominantly axial flow is gradual, for example parabolic.

According to another feature of the invention, the swirling flow takes up the detaching turbulence at the fin flanks, so that the turbulence is not locally recycled in the form of a continuous circulating flow into the fin valleys. Despite the obviously longer distances covered by the particles through the spiral paths, the mean residence time is lower than in a smooth tube and, moreover, more homogeneous over the cross section (cf. FIG. 7). This is confirmed by the higher overall velocity in the profiled tube with swirl (profile 3) compared to the tube with straight fins (profile 2). This is ensured in particular if the swirling flow in the region of the fins or the fins run at an angle of 20° to 40°, for example 30°, preferably 25 to 32.5°, with respect to the tube axis.

According to another feature of the invention, the heat supply, which inevitably differs over the tube circumference between the light side and the dark side, is compensated for in the tube wall and the tube interior, and the heat is rapidly dissipated inward to the core zone. This is associated with a reduction in the risk of local overheating of the process gas at the tube wall, with the resultant formation of pyrolysis coke. Moreover, the thermal loading on the tube material is lower on account of the temperature compensation between the light side and the dark side, which lengthens the service life. Finally, in the process according to the invention, the temperature is also made more uniform over the tube cross section, resulting in an improved olefin yield. The reason for this is that without the radial temperature compensation according to the invention in the tube interior, over-cracking would occur at the hot tube wall and recombination of cracking products would occur in the center of the tube.

Furthermore, a laminar flow layer, which is characteristic of turbulent flows, with a greatly reduced heat transfer is formed in the case of a smooth tube and to a greater extent in the case of fin profiles with an internal circumference which is increased by more than 5%, for example 10%, by fins. This laminar flows leads to the increased formation of pyrolysis coke, likewise with a poor thermal conductivity. The two layers together require greater introduction of heat or a higher burner capacity. This increases the tube metal temperature (TMT) and correspondingly shortens the service life.

The invention avoids this by virtue of the fact that the inner circumference of the profile amounts to around at most 5%, for example 4% or even 3.5%, with respect to the circumference of the envelope circle touching the fin valleys. However, the internal circumference may also be up to 2% smaller than the envelope circle. In other words, the relative profile circumference amounts to at most 1.05 to 0.98% of the envelope circle circumference. Accordingly, the difference in area of the profile tube according to the invention, i.e. its laid-out internal surface area, with respect to a smooth tube having the envelope circle diameter, amounts to at most +5% to −2% or 1.05 to 0.98 times the area of the smooth tube.

The tube profile according to the invention allows a lower tube density (kg/m) compared to a finned tube in which the internal circumference of the profile is at least 10% greater than the circumference of the envelope circle. This is demonstrated by a comparison between two tubes with the same hydraulic diameter and accordingly the same pressure loss and the same thermal result.

A further advantage of the profile circumference according to the invention (relative profile circumference) with respect to the envelope circle circumference is more rapid heating of the charge gas at a reduced tube metal temperature.

The swirling flow according to the invention very considerably reduces the extent of the laminar layer; moreover, it is associated with a velocity vector directed toward the center of the tube, which reduces the residence time of cracking radicals and/or cracking products at the hot tube wall and the chemical and catalytic decomposition thereof to form pyrolysis coke. In addition, the temperature differences between fin valleys and fins, which are not inconsiderable in the case of internally profiled tubes with high fins, are compensated for the by the swirling flow according to the invention. This increases the time between two coke-removal operations being required. Without the swirling flow according to the invention, a not inconsiderable temperature difference results between the fin peaks and the base of the fin valleys. The residence time of the cracking products which tend to coke is shorter in the case of cracking tubes provided with helical inner fins. This is dependent on the nature of the fins in the individual circumstances.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
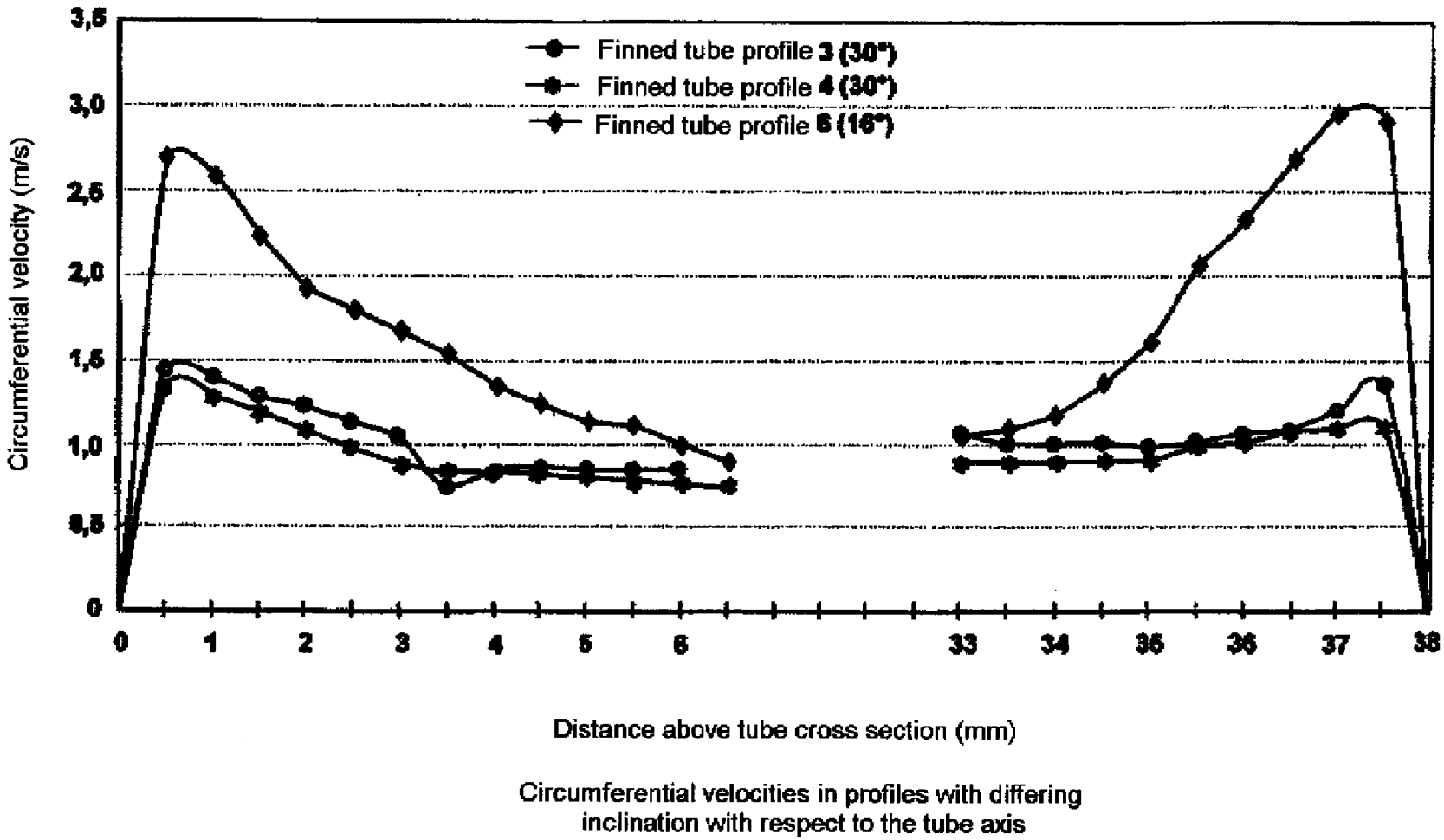
FIG. 1 is a graphical illustration showing circumferential velocities in profiles with differing inclination with respect to the tube axis.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

In the diagram, as shown in FIG. 1:

The upper curve shows: profile 6: 16° pitch

The middle curve shows: profile 3: 30° pitch

The lower curve shows: profile 4: 3 fins with a 30° pitch.

The curves clearly demonstrate that the higher circumferential velocity of the profile 6 with 4.8 mm high fins is consumed within the fin valleys, whereas the circumferential velocity of the profile according to the invention with a fin height of just 2 mm penetrates into the core of the flow. Although the circumferential velocity of the profile 4 with just 3 fins is approximately as high, it does not effect any spiral acceleration of the core flow.

Figure 2:
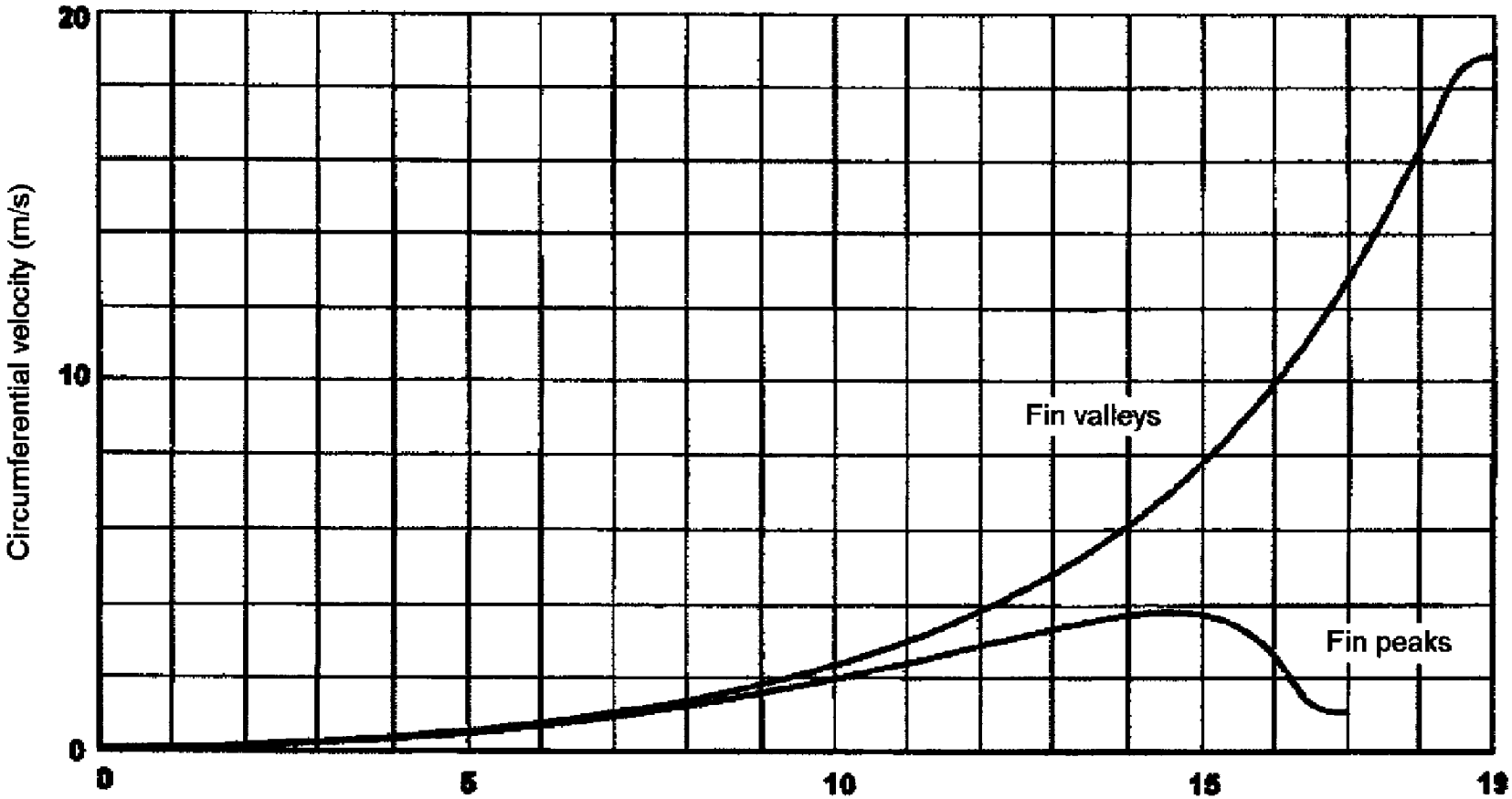
FIG. 2 is a graphical illustration showing curves relating to distribution of the circumferential velocities in profile 3 with 30° pitch over the radius of the profiled tube.

According to the curves shown in the diagram presented in FIG. 2, the profile according to the invention effects a spiral acceleration in the fin valleys (upper branch of the curve) which covers wide areas of the tube cross section and is therefore responsible for homogenizing the temperature in the tube. The lower circumferential velocity at the fin peaks (lower branch of the curve), furthermore, ensures that no turbulence and back-flows occur.

Figure 3:
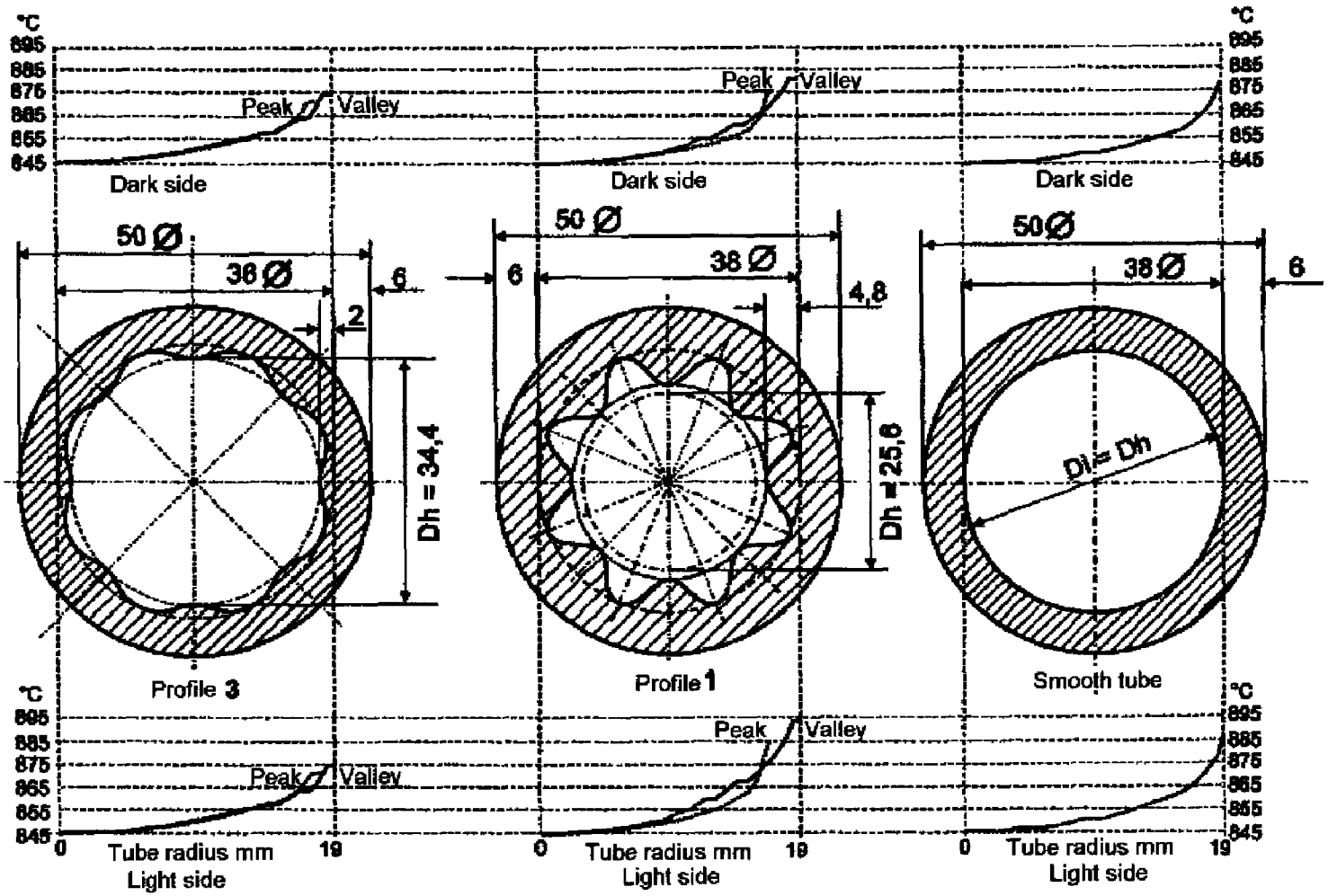
FIG. 3 shows three test tubes, including their data, in cross section.

FIG. 3 illustrates three test tubes, including their data, in cross section; these tubes include the profile 3 according to the invention. The diagrams each indicate the temperature profile across the tube radius on the dark side and the light side. A comparison of the diagrams reveals the lower temperature difference between tube wall and tube center and the lower gas temperature at the tube wall in the case of the profile 3 in accordance with the invention.

Figure 4:
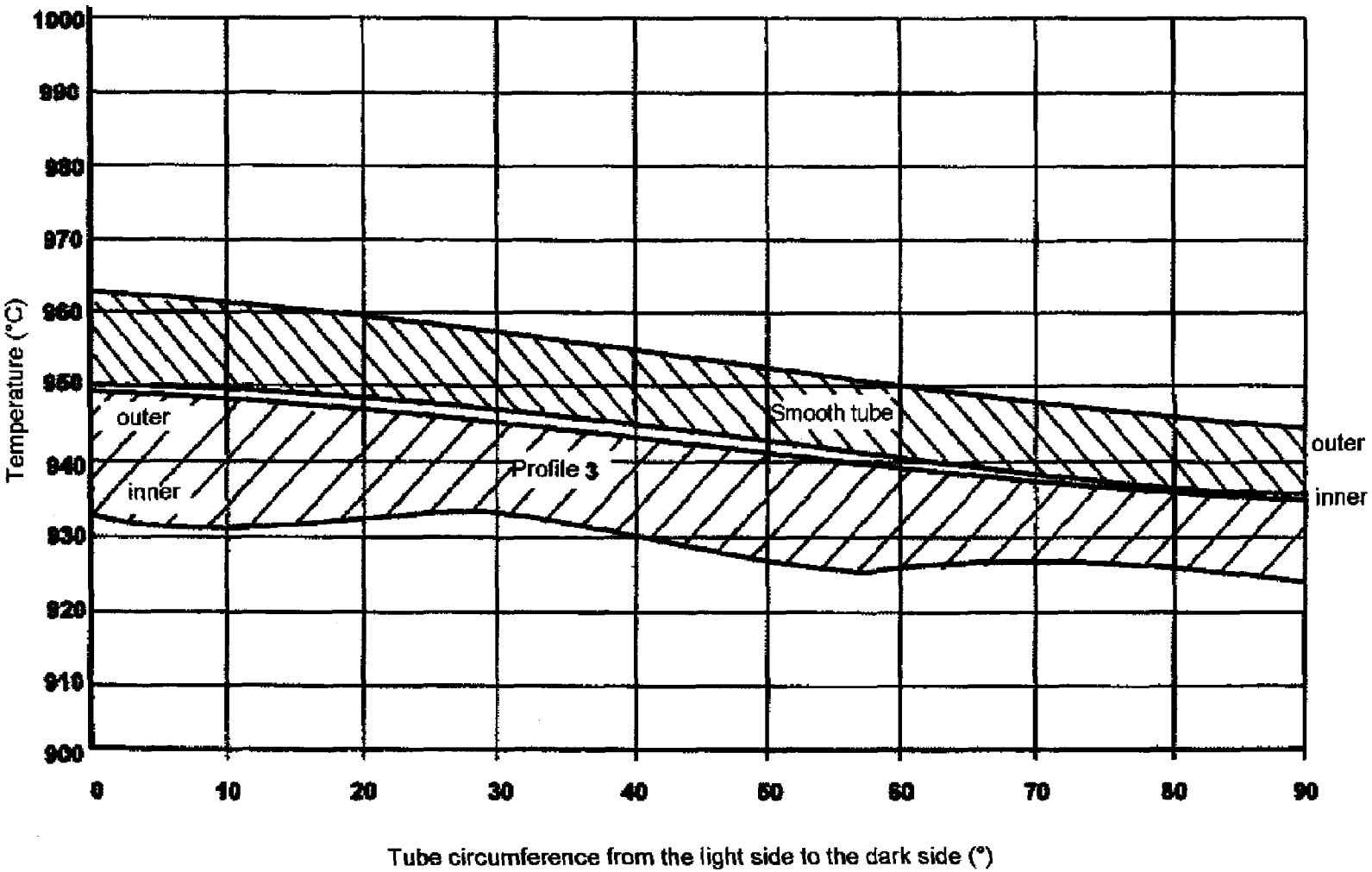
FIG. 4 shows a graphical illustration showing a tube circumference from the light side to the dark side in degrees, depicting a comparison of tube metal temperatures.

The swirling flow according to the invention ensures that the fluctuation in the inner-wall temperature over the circumference of the tube, i.e. between the light side and the dark side, is less than 12° C., even though the tube coils, which are customarily arranged in parallel rows, of a tube furnace are heated or acted on by combustion gases with the aid of side wall burners only on opposite sides and the tubes therefore each have a light side, facing the burners, and a dark side, which is offset through 90° with respect thereto. The mean tube metal temperature, i.e. the difference in the tube metal temperature on the light side and the dark side, leads to internal stresses and therefore determines the service life of the tubes. Therefore, the reduction in the mean tube metal temperature of a tube according to the invention with eight fins with a pitch of 30°, a tube internal diameter of 38.8 mm and a tube external diameter of 50.8 mm, i.e. a difference in height between fin valleys and fin peaks of 2 mm of 11° compared to a smooth tube of the same diameter, based on a mean service life of 5 years, which can be seen from the diagram presented in FIG. 4, results, at an operating temperature of 1050° C., in a calculated increase in service life to approximately 8 years.

Figure 5:
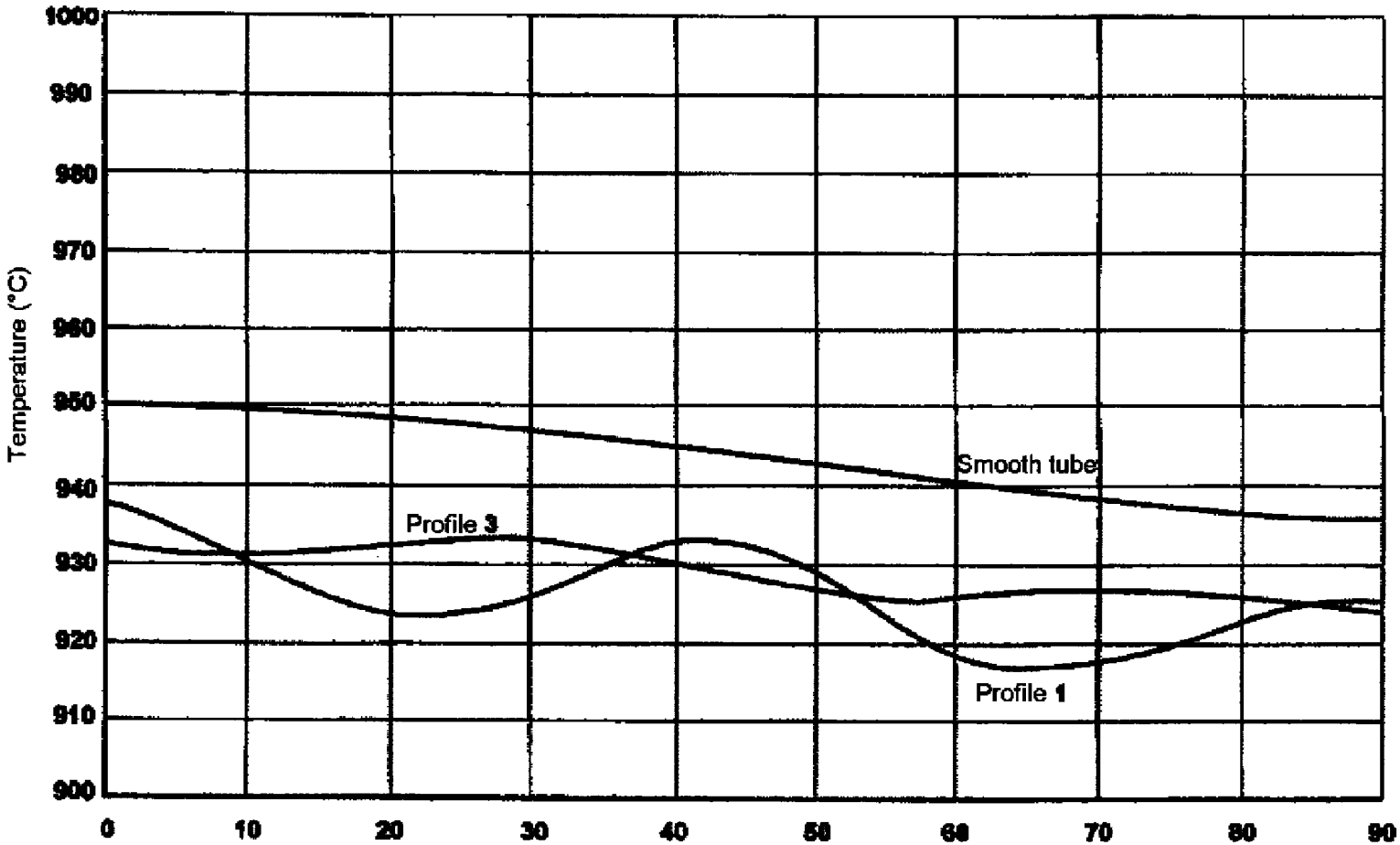
FIG. 5 shows a graphical illustration showing a tube circumference from the light side to the dark side in degrees, depicting a temperature distribution on the tube inner wall at 9950 mm.

The temperature distribution between the light side and the dark side for the three profiles shown in FIG. 3 is to be found in the diagram shown in FIG. 5. The lower level of the temperature curve for the profile 3 compared to the smooth tube (profile 0) and the considerably narrower fluctuation range for the profile 3 curve compared to the profile 1 curve are noticeable.

A particularly expedient temperature distribution is established if the isotherms run in a spiral shape from the tube inner wall to the core of the flow.

A more uniform distribution of the temperature over the cross section results in particular if the circumferential velocity is built up within 2 to 3 m and then remains constant over the entire length of the tube.

With a view to achieving a high olefin yield with a relatively short tube length, the process according to the invention should be operated in such a way that the temperature homogeneity factor over the cross section and the temperature homogeneity factor referenced on the hydraulic diameter is over 1 in relation to the homogeneity factor of a smooth tube ($H_{G\theta}$). In this context, the homogeneity factors are defined as follows:

$$H_{G\theta}[-]H_{P\theta}=\Delta T_0 \cdot d_x/\Delta T_x \cdot d_0$$

The flow configuration according to the invention comprising core flow and swirling flow can be achieved with a finned tube in which the flank angle of the fins, which are in each case continuous over the length of a tube section, i.e. the external angle between the fin flanks and the radius of the tube, is 16° to 25°, preferably 19° to 21°. A flank angle of this type, in particular in combination with a fin pitch of from 20° to 40°, for example 22.5° to 32.5°, ensures that what results in the fin valleys is not a more or less continuous swirling flow which returns to the fin valleys behind the fin flanks and leads to the formation of undesirable "twisters" in the fin valleys. Rather, the turbulence formed in the fin valleys become detached from the fin flanks and are taken up by the swirling flow. The swirl energy induced by the fins accelerates the gas particles and leads to a higher overall velocity. This leads to a reduction in the tube metal temperature, and also makes the latter more uniform, as well as making the temperature and the residence time across the tube cross section more uniform.

Figure 6:
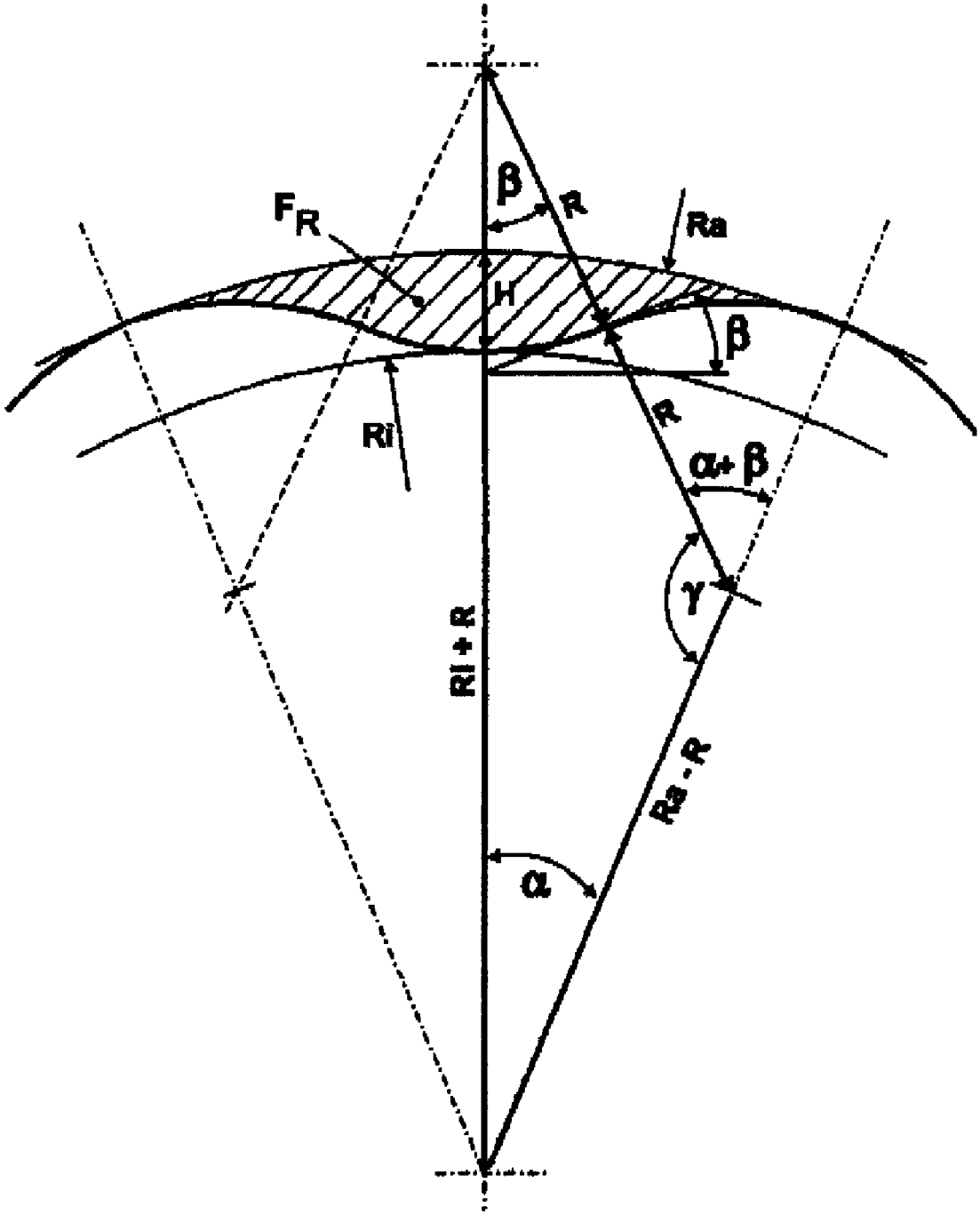
FIG. 6 shows an illustration of a profile segment for mathematical definition of flank angle and profile radii.
Figure 7A:
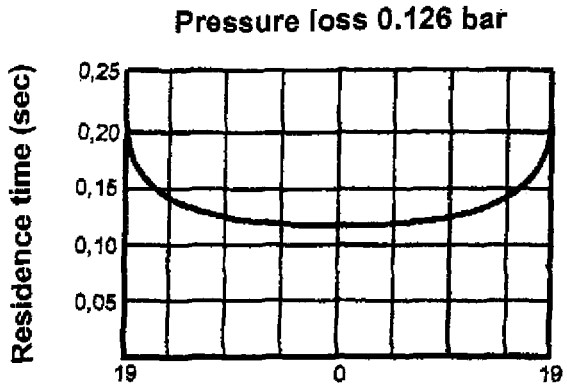
FIGS. 7*a* to 7*d* show illustrations of a comparison between three different profile tubes according to the invention and a smooth tube in relation to flow velocities, residence times and pressure loss.
Figure 7A:
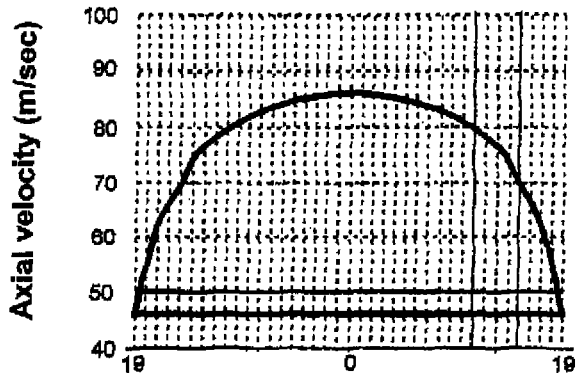
Figure 7A:
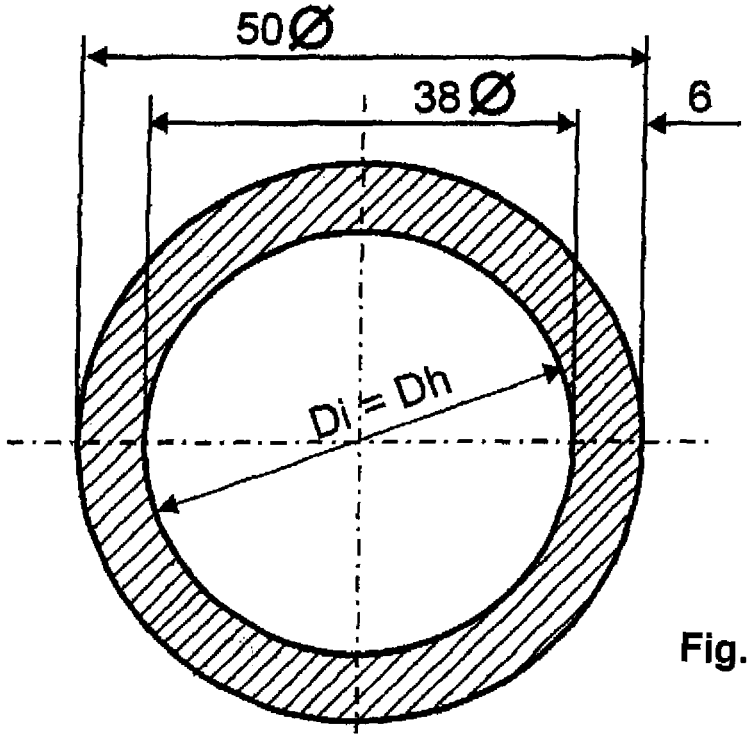
Figure 7B:
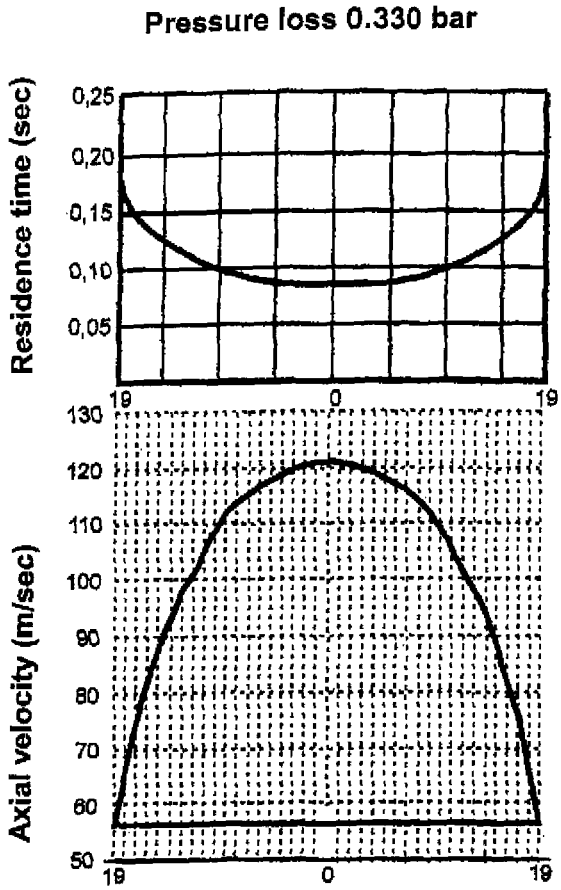
Figure 7B:
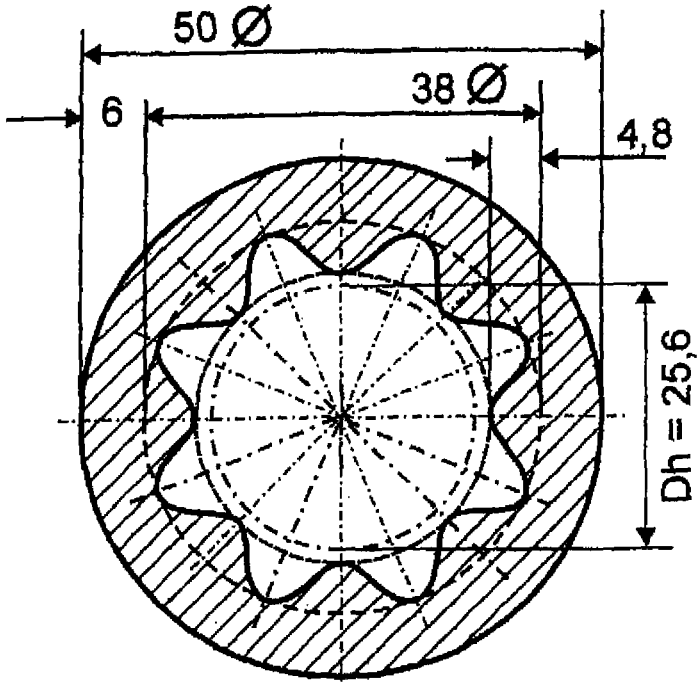
Figure 7C:
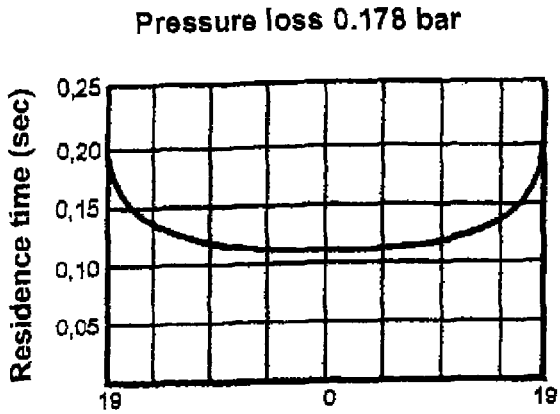
Figure 7C:
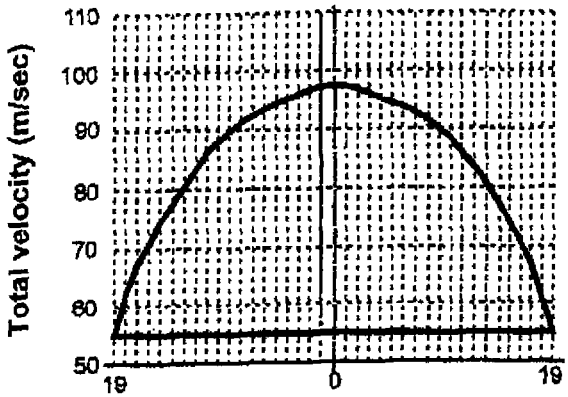
Figure 7C:
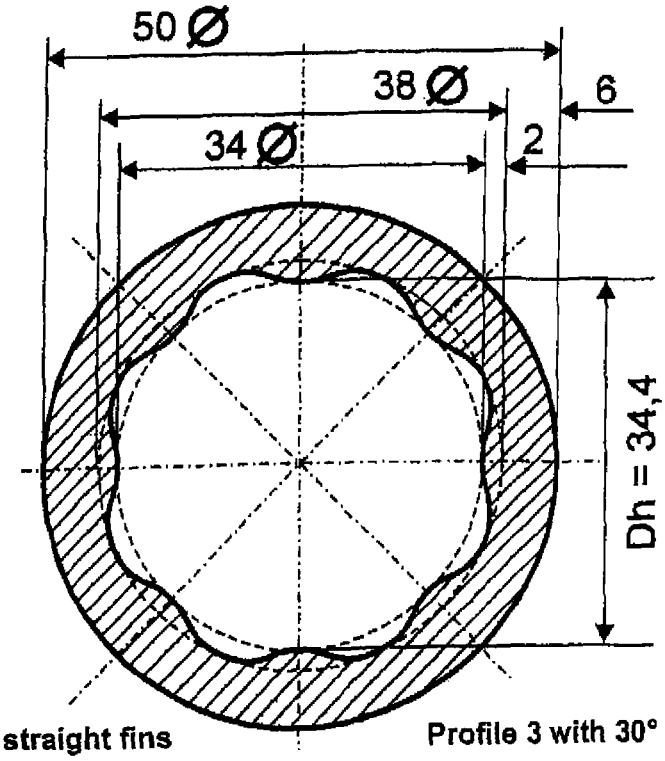
Figure 7D:
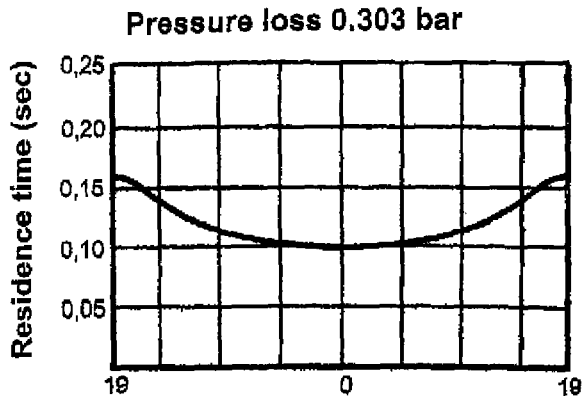
Figure 7D:
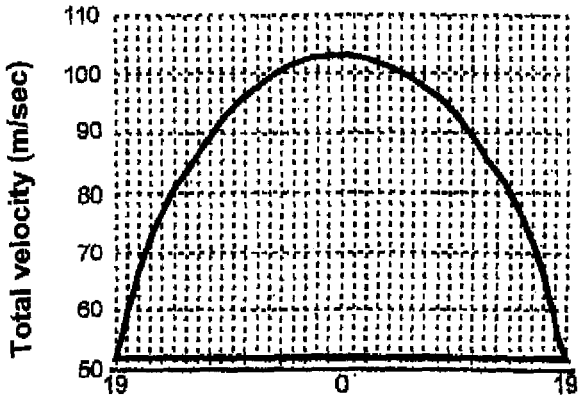
Figure 7D:
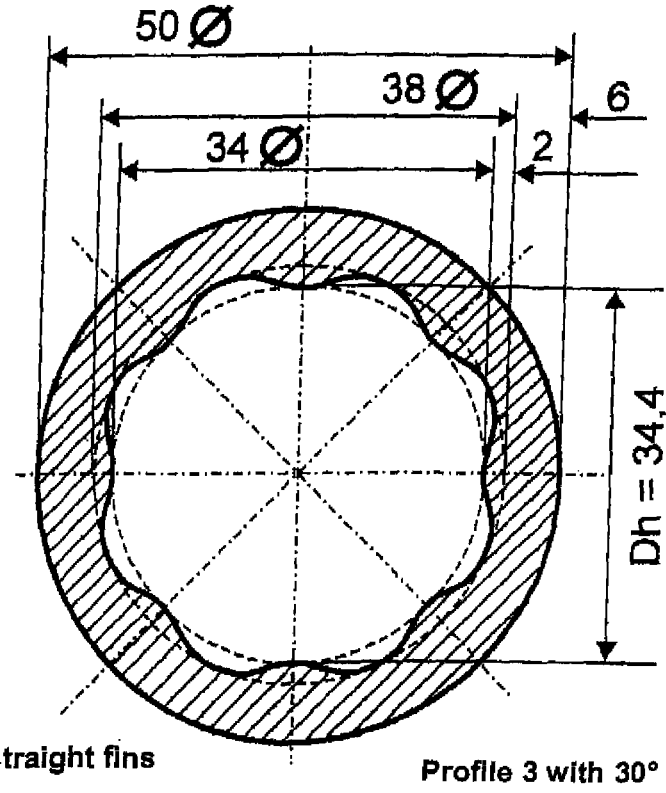

The nature of the finned tube according to the invention can be seen from the illustration of a tube segment in FIG. 6 and the associated characteristic parameters Hydraulic diameter Dh in mm, $Ri \leqq Dh/2$ Flanked angle $\beta$ Fin height H Envelope circle radius $Ra=Ri+H$ and $Da=2\times Ra$ Center angle $\alpha$ Radius of curvature $R=Ra\ (\sin\alpha/2\ \sin\beta+\sin\alpha)$ Envelope circle circumference $2\Pi Ra$ Angle in the oblique-angled triangle $\gamma=180-(\alpha+\beta)$ Internal radius $Ri=2R\ (\sin\gamma/\sin\alpha)-R$ Fin height $H=Ra-Ri$ Profile circumference $U_p=2\times$number of fins$\times\pi R/180\ (2\beta+\alpha)$ Fin surface area $F_R$ Area of the envelope circle $Fa=\pi Da^2/4$ Area of the inner circle $F_i=\Pi \cdot Di$ Profile area within the envelope circle $F_p=F_R \cdot$number of fins Profile circumference $Up=(1.05\text{ to }0.98)\cdot 2\Pi Ra$ The fins and the fin valleys which are located between the fins may be of mirror-symmetrical design in cross section and adjoin one another or may form a wave line with in each case the same radii of curvature. The flank angle then results between the tangents of the two radii of curvature at the contact point and the radius of the tube. In this case, the fins are relatively shallow; fin height and flank angle are matched to one another in such a way that the hydraulic diameter of the profile from the ratio 4×clear cross section/profile circumference is greater than or equal to the inner circle of the profile. The hydraulic diameter is therefore in the inner third of the profile height. Consequently, the fin height and the number of fins increase as the diameter becomes greater, so that the swirling flow is maintained in the direction and intensity required for the action of the profile.

A greater flow velocity (FIG. 2) results between the fins or in the fin valleys, leading to a self-cleaning effect, i.e. to a reduction in the amounts of pyrolysis coke that is deposited.

If the fins are produced by build-up welding or overlay welding using a centrifugally cast tube, the tube wall between the individual fins remains substantially unchanged, so that the fin valleys lie on a common circle which corresponds to the internal circumference of the centrifugally cast tube.

Tests have shown that—irrespective of the internal diameter of the tubes—a total of 8 to 12 fins are sufficient to achieve the flow configuration according to the invention.

In the case of the finned tube according to the invention, the ratio of the quotients of the heat transfer coefficients $Q_R/Q_0$ to the quotient of the pressures losses $\Delta P_R/\Delta P_0$ in the water test, applying and observing the laws of similarity and using the Reynolds numbers given for a naphtha/steam mixture, is preferably from 1.4 to 1.5, where R denotes a finned tube and 0 denotes a smooth tube.

The superiority of the finned tube according to the invention (profile 3) compared to a smooth tube (profile 0) and a finned tube with eight parallel fins (profile 1), among which the radial distance between the fin valleys and the fin peaks is 4.8 mm, is illustrated by the data presented in the table below. The finned tubes all have 8 fins and the same envelope circle.

| PROFILE | 0 | 1 | 3 |
|---|---|---|---|
| Fluid temp. at 9950 mm in the center $T_m$ [° C.] | 843.6 | 848.1 | 843.0 |
| Fluid temp. at 9950 mm at the edge $T_r$ [° C.] | 888.9 | 894 | 874.8 |
| Temperature range at 9950 mm $\Delta T = T_r - T_m$[° C.] | 45.3 | 45.9 | 31.8 |
| Homogeneity factor for the smooth tube H at $H_t = \Delta T_g/\Delta T_k$ | 1 | 0.9869281 | 1.4245283 |
| Hydraulic diameter $d_h$ [m] | 0.0380 | 0.0256 | 0.0344 |
| Homogeneity factor referenced on hydraulic diameter based on the smooth tube $H_{t\omega}:H_{t\omega} = \Delta T_0 \cdot d_x/\Delta T_x \cdot d_0$ | 1 | 0.8477193 | 1.3420556 |
| Classification of H: | 2 | 2 | 1 |

In this context, the hydraulic diameter is defined as follows:

$$D_{hydr}=4\times(\text{clear cross section})/\text{internal circumference};$$

it preferably corresponds to the internal diameter of a comparable smooth tube and then results in a homogeneity factor of 1.425.

In the water test, the finned tube according to the invention gave a heat transfer ($Q_R$) which was higher by a factor of 2.56 than the smooth tube, with a pressure loss ($\Delta P_R$) which was higher only by a factor of 1.76.

FIG. 7 compares three different profile tubes, including a tube according to the invention with 8 fins with a pitch of in each case 30°, of a tube with a smooth internal wall (smooth tube). The hydraulic diameter, the axial velocity, the residence time and the pressure loss are given for each cross section.

The starting data used were the quantitative throughputs in an operational smooth tube with an internal diameter of 38 mm, which is identical to the hydraulic diameter. Using the laws of similarity (same Reynolds numbers), these data were converted by calculation to warm water and used as the basis for the tests (cf. the ratio of the quotients for the heat transfer and the pressure loss for tests with water and the referenced homogeneity factor for the calculation using gases).

The different velocity profiles result from the same quantitative throughputs at different hydraulic diameters (reciprocal relationship).

The comparison of the velocities for the profiles 2 and 3, which are identical in cross section, illustrates the improved velocity, acceleration and residence time with the tubes according to the invention (profile 3). For the same hydraulic diameter, the velocity component in the circumferential direction, caused by the swirling induced by the fins, causes the flow to be detached from the tube wall and induces a helically rising velocity over the entire cross section.

The directed, spiral flow introduces the heat from the tube wall into the flow and therefore distributes it more evenly than in a normal, undirected turbulent flow (smooth tube, profiles 1 and 2). The same applies to the residence time for the particles. The spiral directed flow distributes the particles more uniformly over the cross section, while the acceleration at the profile flanks reduces the mean residence time. The higher pressure loss with the profile 3 results from the circumferential velocity. In the case of profile 1, the cause is the considerable constriction of the flow and the friction loss at the large inner surface of the profile.

Depending on the material, the finned tubes according to the invention can be produced, for example, from a centrifugally cast tube by the ends of a tube with axially parallel fins being rotated with respect to one another, or by the inner profile being produced by deformation of a centrifugally cast tube, for example by hot forging, hot drawing or cold-working by means of a profiling tool, for example a flying mandrel or a mandrel rod with an outer profile which corresponds to the inner profile of the tube.

A number of variants of cutting machines for the internal profiling of tubes are known, for example from German Patent 195 23 280. These machines are also suitable for the production of a finned tube according to the invention.

In the case of hot-forming, the deformation temperature should be set in such a way that the microstructural grain is partially destroyed in the region of the internal surface, and is accordingly recrystallized at a later stage under the influence of the operating temperature. The result of this is a fine-grained microstructure which allows rapid diffusion of chromium, silicon and/or aluminum through the austenitic matrix to the inner surface of the tube, where an oxidic protective layer is then rapidly built up.

The fins according to the invention can also be produced by build-up welding; in this case, it is not possible to form a curved fin base between the individual fins, but rather the original profile of the inner wall of the tube is substantially maintained there.

The inner surface of the tube according to the invention should have the lowest possible roughness; it can therefore be smoothed, for example mechanically polished or electrolytically leveled.

Suitable tube materials for use in ethylene plants are iron and/or nickel alloys containing 0.1% to 0.5% of carbon, 20 to 35% of chromium, 20 to 70% of nickel, up to 3% of silicon, up to 1% of niobium, up to 5% of tungsten and additions of hafnium, titanium, rare earths or zirconium, in each case of up to 0.5%, and up to 6% of aluminum.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A finned tube for the thermal cracking of hydrocarbons in the presence of steam, said tube defined by a tube axis and comprising a plurality of helically extending inner fins, said fins being inclined at an angle of 20° to 40° in relation to the tube axis, said inner fins having an undulating structure with adjoining radially outward facing valleys and radially inward facing peaks arranged mirror-symmetrically with respect to one another in cross section and having an identical radius of curvature, and a flank angle of 16° to 25° , said flank angle defined as an angle enclosed between a line tangential to an inscribed circle at a peak and a line tangential at a connecting point of the peaks and the valleys of the undulating structure.

2. The finned tube of claim 1, wherein the fins are inclined at an angle of 22.5° to 32.5° in relation to the tube axis.

3. The finned tube of claim 1, wherein a profile circumference of the tube amounts to +5 to −2% of an envelope circle touching valleys of the fins.

4. The finned tube of claim 1, wherein the flank angle of the fins is 16° to 20°.

5. The finned tube of claim 1, wherein the tube has a total of 6 to 12 fins.

6. The finned tube of claim 1, wherein the finned tube has a hydraulic diameter which is at least equal to a diameter of an inner circle of the tube.

7. The finned tube of claim 1, wherein a ratio of the quotients of the heat transfer coefficients $Q_R/Q_0$ to a quotient of the pressure losses $\Delta P_R/\Delta P_0$ in a water test is 1.4 to 1.5, wherein R denotes a finned tube and 0 denotes a smooth tube.

8. The finned tube of claim 1, wherein the radius of curvature of a fin cross section is 3.5 to 20 mm.

9. The finned tube of claim 1, wherein the fins have a fin height of 1.25 to 3 mm.

10. The finned tube of claim 1, wherein a clear cross section within a profile circumference amounts to 85 to 95% of an area of the envelope circle.

11. The finned tube of claim 1, wherein a profile area amounts to 40 to 50% of an annular area between an envelope circle and an inner circle of the tube.

12. The finned tube of claim 1, wherein the tube is a centrifugally cast tube made of a nickel alloy containing 0.1 to 0.5% of carbon, 20 to 35% of chromium, 20 to 70% of nickel, up to 3% of silicon, up to 1% of niobium, up to 5% of tungsten and in each case up to 0.5% of hafnium, titanium, rare earths, zirconium, and up to 6% of aluminium, the balance being iron.

13. The finned tube of claim 12, wherein the alloy contains, individually or in combination with one another, at least 0.02% of silicon, 0.1% of niobium, 0.3% of tungsten and 1.5% of aluminium.

14. The finned tube of claim 1, wherein the inner fins have a peak-to-valley height and a radial peak-to-peak spacing, wherein a ratio of the peak-to-valley height to the radial peak-to-peak spacing is greater than about 5.

* * * * *